US009243639B2

(12) United States Patent
Nagano et al.

(10) Patent No.: US 9,243,639 B2
(45) Date of Patent: Jan. 26, 2016

(54) SCROLL COMPRESSOR INCLUDING A SEALING MEMBER

(71) Applicant: KABUSHIKI KAISHA TOYOTA JIDOSHOKKI, Kariya-shi, Aichi-ken (JP)

(72) Inventors: Hiroki Nagano, Kariya (JP); Tatsushi Mori, Kariya (JP); Ken Suitou, Kariya (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 0 days.

(21) Appl. No.: 14/193,801

(22) Filed: Feb. 28, 2014

(65) Prior Publication Data

US 2014/0248172 A1 Sep. 4, 2014

(30) Foreign Application Priority Data

Mar. 4, 2013 (JP) ..... 2013-041915

(51) Int. Cl.
*F03C 2/00* (2006.01)
*F03C 4/00* (2006.01)
(Continued)

(52) U.S. Cl.
CPC ..... *F04C 27/005* (2013.01); *F01C 19/005* (2013.01); *F01C 19/08* (2013.01);
(Continued)

(58) Field of Classification Search
CPC .. F04C 18/0215; F04C 23/008; F04C 27/005; F01C 19/08; F01C 19/10; F01C 19/12; F05C 2225/00; F05C 2225/02; F05C 2225/04; F05C 2225/06; F05C 2225/10; F05C 2225/12; F05C 2253/20
USPC ..... 418/55.1–55.6, 57, 142, 152–153
See application file for complete search history.

(56) References Cited

U.S. PATENT DOCUMENTS 3,663,024 A * 5/1972 Traub ..... 277/589
4,151,999 A * 5/1979 Ringel et al. ..... 277/589
(Continued)

FOREIGN PATENT DOCUMENTS

JP 60-252184 A 12/1985
JP 1173485 U 12/1989
(Continued)

OTHER PUBLICATIONS

Communication dated Apr. 28, 2015, issued by the Japan Patent Office in corresponding Japanese Application No. 2013-041915.
(Continued)

*Primary Examiner* — Theresa Trieu
(74) *Attorney, Agent, or Firm* — Sughrue Mion, PLLC

(57) ABSTRACT

A scroll compressor includes a housing, a fixed scroll, and a movable scroll. A compression chamber is formed between the movable scroll and the fixed scroll. An opposing wall is located in and fixed to the housing. A back pressure region is formed between the opposing wall and the movable scroll, and a back pressure in the back pressure region urges the movable scroll toward the fixed scroll. An annular sealing member is arranged between the movable scroll and the opposing wall. The movable scroll includes a holding portion that holds the sealing member. The sealing member includes a rubber portion, which elastically deforms in the holding portion, and a resin portion, which is made of a material harder than the rubber portion. The resin portion at least partially projects out of the holding portion toward the opposing wall. The resin portion is in contact with the opposing wall.

10 Claims, 5 Drawing Sheets

(51) Int. Cl.

| | |
|---|---|
| ***F04C 2/00*** | (2006.01) |
| ***F04C 27/00*** | (2006.01) |
| ***F04C 18/02*** | (2006.01) |
| ***F01C 19/08*** | (2006.01) |
| ***F01C 19/10*** | (2006.01) |
| ***F01C 19/00*** | (2006.01) |
| *F04C 23/00* | (2006.01) |

(52) U.S. Cl.

CPC ..... *F01C 19/10* (2013.01); *F04C 18/0215* (2013.01); *F04C 18/0284* (2013.01); *F04C 23/008* (2013.01); *F05C 2225/02* (2013.01); *F05C 2225/04* (2013.01); *F05C 2253/20* (2013.01)

(56) References Cited

U.S. PATENT DOCUMENTS

| | | | | |
|---|---|---|---|---|
| 6,872,063 | B2 | 3/2005 | Kimura et al. | |
| 2001/0038800 | A1* | 11/2001 | Kimura et al. | 418/55.4 |
| 2003/0000238 | A1 | 1/2003 | Uchida et al. | |
| 2005/0249623 | A1 | 11/2005 | Tsuchiya et al. | |
| 2007/0207047 | A1* | 9/2007 | Midorikawa | 418/55.4 |
| 2009/0246059 | A1 | 10/2009 | Nakamura et al. | |
| 2011/0243777 | A1 | 10/2011 | Ito et al. | |
| 2013/0209305 | A1 | 8/2013 | Takei | |

FOREIGN PATENT DOCUMENTS

| | | | |
|---|---|---|---|
| JP | 558885 | U | 8/1993 |
| JP | 9177685 | A | 7/1997 |
| JP | 2001-336487 | A | 12/2001 |
| JP | 2002-54583 | A | 2/2002 |
| JP | 2004-144045 | A | 5/2004 |
| JP | 3584533 | B2 | 11/2004 |
| JP | 2005320885 | A | 11/2005 |
| JP | 2007231796 | A | 9/2007 |
| JP | 2010-84687 | A | 4/2010 |
| JP | 201127076 | A | 2/2011 |
| JP | 2011064189 | A | 3/2011 |
| WO | 2012005150 | A1 | 1/2012 |

OTHER PUBLICATIONS

Communication dated Jan. 20, 2015 from the Japanese Patent Office in counterpart application No. 2013-041915.

Communication dated Mar. 30, 2015 from the European Patent Office in counterpart European Application No. 14156956.6.

* cited by examiner

SCROLL COMPRESSOR INCLUDING A SEALING MEMBER

BACKGROUND OF THE INVENTION

The present invention relates to a scroll compressor.

Generally, a scroll compressor includes a fixed scroll, which is fixed to a housing, and a movable scroll, which orbits with respect to the fixed scroll. The fixed scroll includes a fixed base plate and a fixed spiral wall projecting from the fixed base plate. The movable scroll includes a movable base plate and a movable spiral wall projecting from the movable base plate. The fixed spiral wall and the movable spiral wall are engaged with each other to define a compression chamber. The orbital movement of the movable scroll decreases the volume of the compression chamber and compresses refrigerant.

Japanese Laid-Open Patent Publication No. 2004-144045 describes an example of a scroll compressor that includes an elastic body arranged between the housing and the movable base plate of the movable scroll. A reactive force produced by a compression stroke produces a reactive force that acts on the movable scroll in the thrust direction. The elastic body counters the reactive force to enhance the sealing of the compression chamber.

Referring to FIG. 7, a scroll compressor 110 of the publication includes a housing 100, which accommodates a movable scroll 101 including a movable base plate 102. An elastic body 103 (sealing member) is arranged on the back surface of the movable base plate 102. The elastic body 103 is flat and annular and made of a metal material such as a carbon tool steel. In the housing 100, an opposing wall 105 is arranged at the side of the movable scroll 101 facing away from the fixed scroll 104. The opposing wall 105 faces toward the movable scroll 101. The back surface of the movable base plate 102 includes a contact portion 102*a*. The elastic body 103 is fixed in the housing 100 between the movable scroll 101 and the opposing wall 105 so that the elastic body 103 and the contact portion 102*a* are pressed against each other. The pressing between the elastic body 103 and the contact portion 102*a* is ensured at any orbital position of the movable scroll 101 relative to the fixed scroll 104.

In the housing 100, a back pressure chamber 107 (back pressure region) is defined at the inner side of the contact portion 102*a*. The pressing between the elastic body 103 and the contact portion 102*a* seals the back pressure chamber 107 from the region at the outer side of the contact portion 102*a* in the housing 100. The supply of refrigerant to the back pressure chamber 107 generates pressure (back pressure) acting to urge the movable scroll 101 toward the fixed scroll 104. This enhances the sealing of the compression chamber 108.

In addition, the opposing wall 105 includes a recess 105*a* that allows for elastic deformation of the elastic body 103. The pressing between the elastic body 103 and the contact portion 102*a* elastically deforms the elastic body 103 toward the opposing wall 105. The deformed elastic body 103 produces a resilient force that acts to restore the original shape of the elastic body 103. This urges the movable scroll 101 toward the fixed scroll 104. Thus, the movable scroll 101 is urged toward the fixed scroll 104 even when the back pressure in the back pressure chamber 107 is insufficient such as when the scroll compressor 110 starts to operate. This enhances the sealing of the compression chamber 108.

However, the elastic body 103 of the scroll compressor 110 is made of metal. Thus, the pressing between the elastic body 103 and the contact portion 102*a* may not be able to sufficiently seal the back pressure chamber 107 from the region at the outer side of the contact portion 102*a* in the housing 100. This may result in the leakage of refrigerant from the back pressure chamber 107 to the region at the outer side of the contact portion 102*a* in the housing 100.

During a normal operation of the scroll compressor 110, the movable scroll 101 is urged toward the fixed scroll 104 by the urging force produced by the elastic deformation of the elastic body 103, as well as the urging force produced by the back pressure in the back pressure chamber 107. When the urging force of the back pressure in the back pressure chamber 107 sufficiently urges the movable scroll 101 toward the fixed scroll 104 and enhances the sealing of the compression chamber 108, the urging force produced by the elastic deformation of the elastic body 103 would result in excessive pressing of the movable scroll 101 against the fixed scroll 104. This increases the sliding resistance between the movable scroll 101 and the fixed scroll 104 when the movable scroll 101 orbits. The sliding resistance causes mechanical loss during normal operation of the scroll compressor 110.

SUMMARY OF THE INVENTION

It is an object of the present invention to provide a scroll compressor that minimizes leakage of refrigerant from a back pressure region and limits mechanical loss.

To achieve the above object, one aspect of the present invention is a scroll compressor that includes a housing, a fixed scroll located in and fixed to the housing, and a movable scroll that orbits with respect to the fixed scroll. A compression chamber is formed between the movable scroll and the fixed scroll. An opposing wall is located in and fixed to the housing. A back pressure region is formed between the opposing wall and the movable scroll, and a back pressure in the back pressure region urges the movable scroll toward the fixed scroll. An annular sealing member is arranged between the movable scroll and the opposing wall. The movable scroll includes an end surface that faces the opposing wall and includes a holding portion. The holding portion holds the sealing member. The sealing member includes a rubber portion, which elastically deforms in the holding portion, and a resin portion, which is made of a material harder than the rubber portion. The resin portion at least partially projects out of the holding portion toward the opposing wall. The resin portion is in contact with the opposing wall.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE INVENTION

Figure 1:
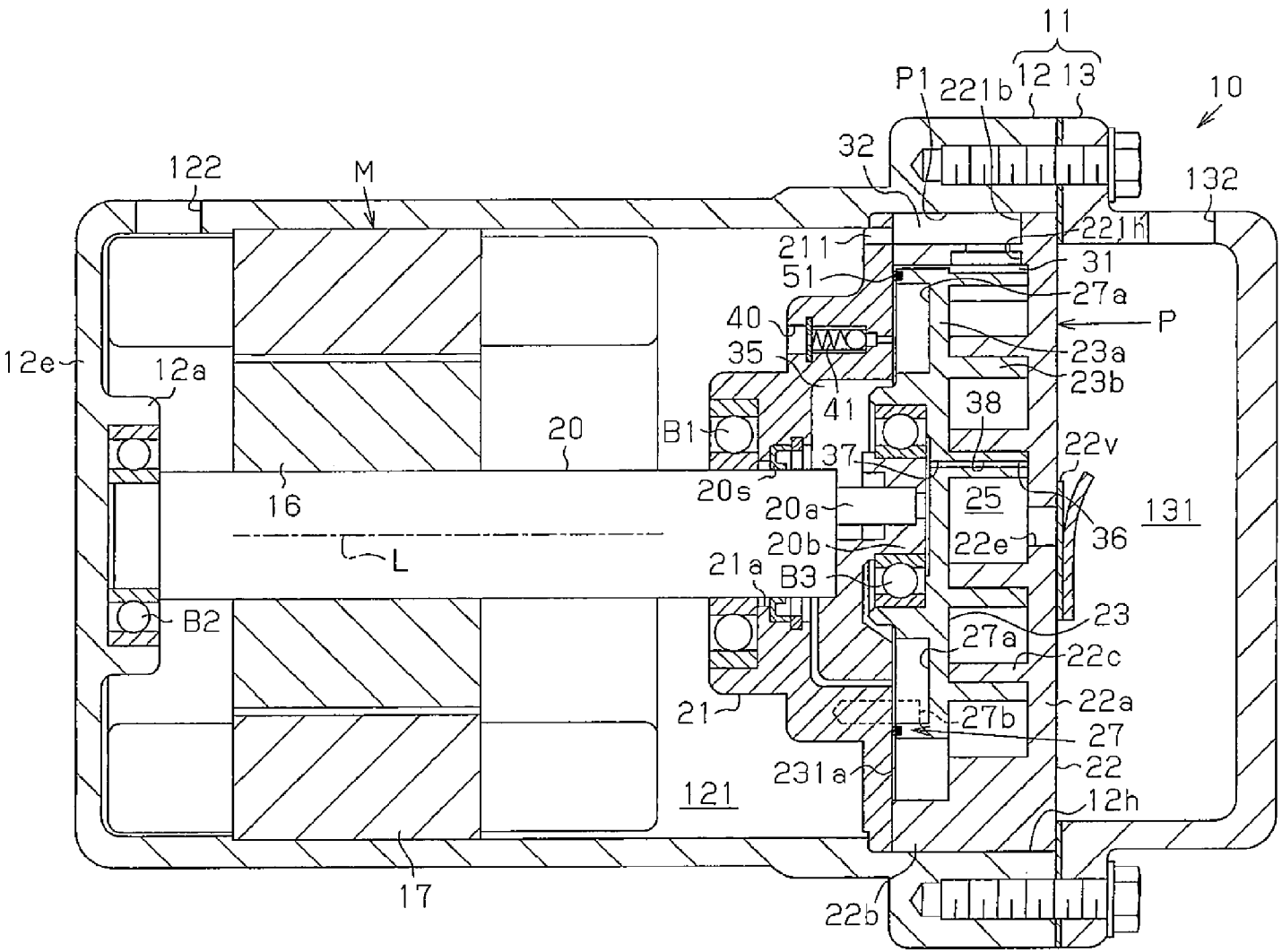
FIG. 1 is a cross-sectional view showing a scroll compressor of one embodiment.
Figure 2:
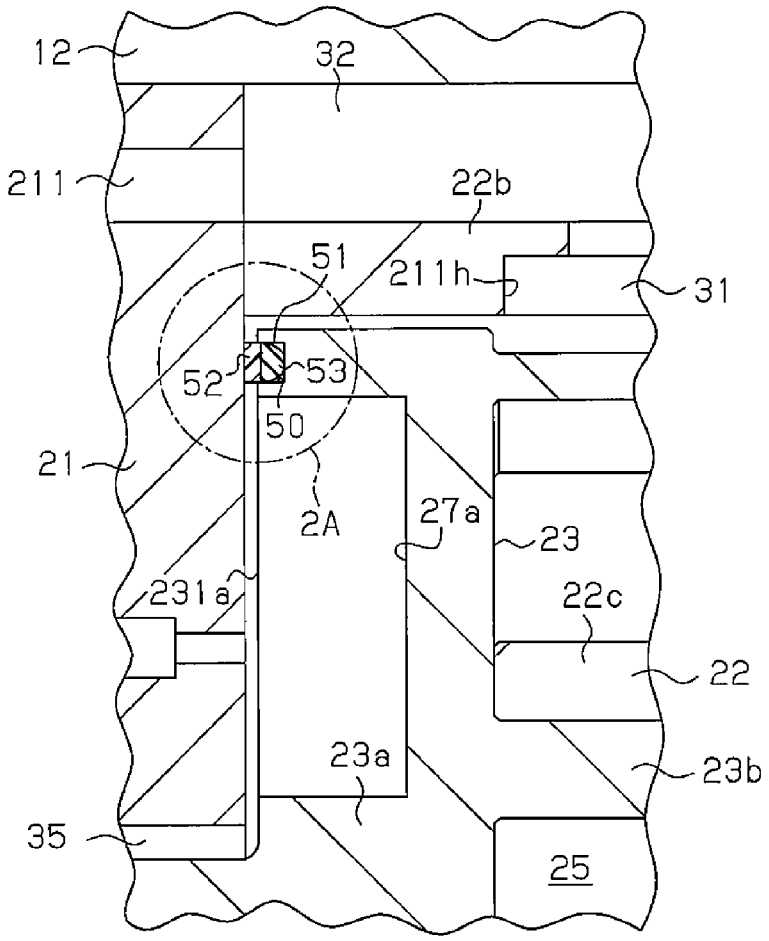
FIG. 2 is an enlarged cross-sectional view showing the scroll compressor of FIG. 1.
Figure 3:
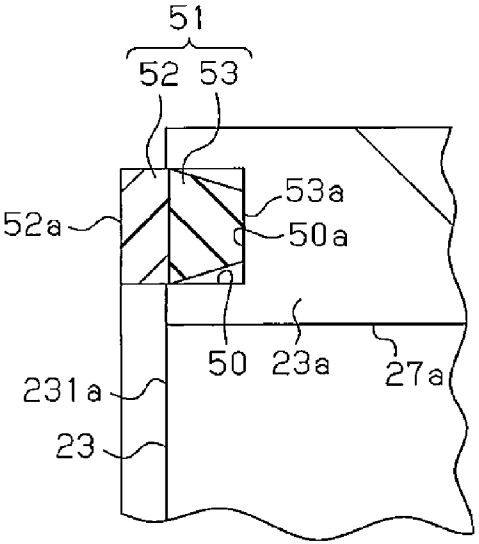
FIG. 3 is an enlarged cross-sectional view showing a sealing member before a rubber portion elastically deforms.

Referring to FIGS. 1 to 3, one embodiment of a scroll compressor (hereinafter referred to as the compressor) will now be described. The compressor is installed in a vehicle and used with a vehicle air-conditioning device.

As shown in FIG. 1, a scroll compressor 10 includes a housing 11 made of metal (aluminum in the present embodiment). The housing 11 includes a cylindrical motor housing member 12 and a cylindrical discharge housing member 13. The motor housing member 12 includes a closed end and an open end 12*h* (left end as viewed in FIG. 1). The discharge housing member 13, which has a closed end, is connected to the open end 12*h* of the motor housing member 12. The motor housing member 12 accommodates a compression unit P, which compresses refrigerant, and an electric motor M, which drives the compression unit P.

The motor housing member 12 includes an end portion 12*e* and a cylindrical shaft support portion 12*a* projecting from the central section of the end portion 12*e*. The shaft support portion 12*a* is formed integrally with the end portion 12*e*. A cylindrical partition 21 is fixed in the motor housing member 12 near the open end 12*h*. The partition 21 includes an insertion hole 21*a* that extends through the central section of the partition 21. The partition 21 divides the motor housing member 12 into a motor chamber 121, which accommodates the electric motor M, and an accommodation portion P1, which accommodates the compression unit P. The motor chamber 121 is located between the partition 21 and the end portion 12*e*, and the accommodation portion P1 is located between the partition 21 and the open end 12*h*.

The motor housing member 12 also accommodates a rotation shaft 20. The rotation shaft 20 includes two ends. One end, which faces toward the open end 12*h* of the motor housing member 12, is located in the insertion hole 21*a* of the partition 21 and supported by a bearing B1 to be rotatable relative to the partition 21. The other end of the rotation shaft 20 faces toward the end portion 12*e* of the motor housing member 12 and is supported by a bearing B2 to be rotatable relative to the shaft support portion 12*a*. A shaft sealing member 20*s* is arranged between the partition 21 and the rotation shaft 20.

The electric motor M includes a rotor 16, which rotates integrally with the rotation shaft 20, and a stator 17, which surrounds the rotor 16 and is fixed to the inner surface of the motor housing member 12. When the stator 17 is supplied with power, the rotor 16 and the rotation shaft 20 rotate integrally.

The compression unit P includes a fixed scroll 22 and a movable scroll 23. The fixed scroll 22 includes a circular fixed base plate 22*a*, a cylindrical peripheral wall 22*b* projecting from the periphery of the fixed base plate 22*a*, and a fixed spiral wall 22*c* projecting from the fixed base plate 22*a* at the inner side of the peripheral wall 22*b*. The fixed scroll 22 is fitted into and fixed to the motor housing member 12.

The movable scroll 23 includes a circular movable base plate 23*a* and a movable spiral wall 23*b* projecting from the movable base plate 23*a* toward the fixed base plate 22*a*. The movable scroll 23 is arranged between the partition 21 and the fixed scroll 22. The movable scroll 23 is supported in a manner allowing for the movable scroll 23 to orbit with respect to the fixed scroll 22.

The fixed spiral wall 22*c* and the movable spiral wall 23*b* are engaged with each other. The fixed spiral wall 22*c* has a distal surface that is in contact with the movable base plate 23*a*. The movable spiral wall 23*b* has a distal surface that is in contact with the fixed base plate 22*a*. The fixed base plate 22*a*, the fixed spiral wall 22*c*, the movable base plate 23*a*, and the movable spiral wall 23*b* define a compression chamber 25. That is, the compression chamber 25 is formed between the fixed scroll 22 and the movable scroll 23.

An eccentric shaft 20*a* projects from the end surface of the rotation shaft 20 that faces toward the open end 12*h*. The eccentric shaft 20*a* is eccentric to the rotation axis L of the rotation shaft 20. The eccentric shaft 20*a* is fitted into and fixed to a bushing 20*b*. The movable base plate 23*a* is supported by the bushing 20*b* to be rotatable relative the bushing 20*b*. A bearing B3 is arranged between the movable base plate 23*a* and the bushing 20*b*.

A rotation restriction mechanism 27 is arranged between the movable base plate 23*a* and the partition 21. The rotation restriction mechanism 27 includes a plurality of circular holes 27*a*, which are arranged in the outer circumferential portion of an end surface 231*a* of the movable base plate 23*a* that faces the partition 21, and a plurality of cylindrical pins 27*b* (only one shown in FIG. 1), which project from the outer circumferential portion of the end surface of the partition 21 that faces the movable base plate 23*a*. The pins 27*b* are loosely fitted into the circular holes 27*a*.

When the rotation shaft 20 is driven by the electric motor M and rotated, the movable scroll 23, which is coupled to the rotation shaft 20 by the eccentric shaft 20*a*, orbits about the axis of the fixed scroll 22 (the rotation axis L of the rotation shaft 20). The rotation restriction mechanism 27 prevents rotation of the movable scroll 23 while permitting the orbital motion. The orbital motion of the movable scroll 23 reduces the volume of the compression chamber 25.

The peripheral wall 22*b* of the fixed scroll 22 and the outermost portion in the movable spiral wall 23*b* of the movable scroll 23 define a suction chamber 31 that is in communication with the compression chamber 25. The peripheral wall 22*b* of the fixed scroll 22 has an outer surface including a recess 221*b*. The area surrounded by the recess 221*b* and the inner surface of the motor housing member 12 forms a suction passage 32 that is connected to the suction chamber 31 through a through hole 221*h* in the peripheral wall 22*b* of the fixed scroll 22. A through hole 211, which extends through the peripheral portion of the partition 21 connects the suction passage 32 to the motor chamber 121.

The motor housing member 12 includes a suction port 122. The suction port 122 is connected to an external refrigerant circuit (not shown). Refrigerant (gas) is drawn into the motor chamber 121 from the external refrigerant circuit through the suction port 122. The refrigerant in the motor chamber 121 is then sent to the compression chamber 25 through the through hole 211, the suction passage 32, the through hole 221*h*, and the suction chamber 31. Thus, the motor chamber 121, the through hole 211, the suction passage 32, the through hole 221*h*, and the suction chamber 31 form a suction pressure region.

The refrigerant in the compression chamber 25 is compressed by the orbiting motion (discharging motion) of the movable scroll 23 and discharged into a discharge chamber 131 of the discharge housing member 13 through a discharge port 22*e* by forcibly opening a discharge valve 22*v*. The refrigerant is then discharged to the external refrigerant circuit through a discharge port 132 formed in the discharge housing member 13. Thus, the discharge chamber 131 forms a discharge pressure region.

The area surrounding the rotation shaft 20 between the movable scroll 23 and the partition 21 forms a back pressure chamber 35. The back pressure chamber 35 is in communication with the circular holes 27*a*. Further, the movable scroll 23 includes an inlet 36, which opens in the distal surface of the movable spiral wall 23*b*, an outlet 37, which opens in the back pressure chamber 35, and a communication passage 38, which communicates the inlet 36 and the outlet 37. When the pressure in the compression chamber 25 excessively increases and moves the distal surface of the movable spiral wall 23*b* away from the fixed base plate 22*a*, the compressed refrigerant in the compression chamber 25 flows into the inlet 36 through the gap between the distal surface of the movable spiral wall 23*b* and the fixed base plate 22*a*. The refrigerant then flows through the communication passage 38 and the outlet 37 into the back pressure chamber 35 and the circular holes 27*a*. This increases the pressure (back pressure) in the back pressure chamber 35 and the circular holes 27*a*. The back pressure produces an urging force that urges the movable scroll 23 toward the fixed scroll 22. In the present embodiment, the back pressure chamber 35 and the circular holes 27*a* form a back pressure region that produces the urging force urging the movable scroll 23 toward the fixed scroll 22 when the refrigerant flows into the back pressure chamber 35 and the circular holes 27*a*. The partition 21 serves as an opposing wall that defines the back pressure region between the movable scroll 23 and the opposing wall.

A bleed passage 40 extending through the partition 21 connects the motor chamber 121 to the back pressure chamber 35 and the circular holes 27*a*. A regulating valve 41 is arranged in the bleed passage 40 to regulate the open degree of the bleed passage 40 in accordance with the difference between the pressure in the motor chamber 121 and the back pressure in the back pressure chamber 35 and the circular holes 27*a*. The regulating valve 41 is operated to maintain a constant difference between the pressure in the motor chamber 121 and the back pressure in the back pressure chamber 35 and the circular holes 27*a*. Thus, during normal operation of the scroll compressor 10, the regulating valve 41 functions to keep constant the back pressure in the back pressure chamber 35 and the circular holes 27*a* and, consequently, the urging force of the movable scroll 23 produced by the back pressure.

As shown in FIG. 2, the end surface 231*a* of the movable scroll 23 includes a groove 50 that serves as a holding portion. The groove 50 is located at a position separated from the outer circumferential surface of the movable scroll 23. The groove 50 is annular and located at the radially outer side of the circular holes 27*a* in the end surface 231*a* of the movable scroll 23. The groove 50 receives an annular sealing member 51.

Figure 2A:
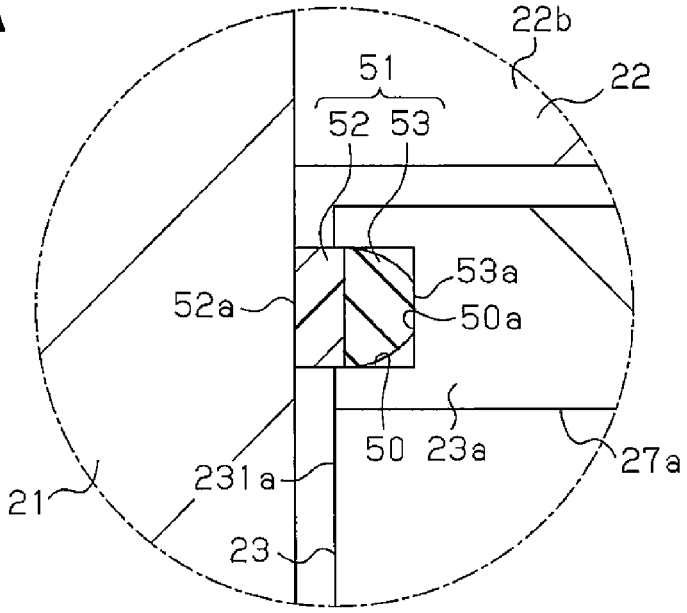
FIG. 2A is an enlarged view showing the area in circle 2A in FIG. 2.

As shown in FIG. 2A, the sealing member 51 includes a rubber portion 53, which elastically deforms in the groove 50, and a resin portion 52, which is made of a material harder than the rubber portion 53. The rubber portion 53 may be made of hydrogenated nitrile butadiene rubber (HNBR), ethylene propylene rubber (EPM, EPDM), or chloroprene rubber (CR), for example. Preferably, the rubber portion 53 may be made of HNBR. The resin portion 52 may be made of polytetrafluoroethylene (PTFE), for example. The resin portion 52 is formed integrally with the rubber portion 53. The resin portion 52 is located between the rubber portion 53 and the partition 21. The resin portion 52 partially projects out of the groove 50 toward the partition 21. The resin portion 52 includes a flat surface 52*a* that faces the partition 21 and is in planer contact with the partition 21.

FIG. 3 shows the sealing member 51 before the rubber portion 53 elastically deforms. The rubber portion 53 is tapered so that the diameter becomes smaller at locations farther from the resin portion 52. Since the radial width of the rubber portion 53 varies in the axial length of the rubber portion 53, the rubber portion 53 partially has a smaller radial width than the resin portion 52. As shown in FIG. 2A, a space is formed between the outer surface of the rubber portion 53 and the wall surface of the groove 50. The space allows the rubber portion 53 to elastically deform in the groove 50. The rubber portion 53 includes a flat distal end 53*a* in contact with an end portion 50*a* of the groove 50. The sealing member 51 is held in the groove 50 with the rubber portion 53 elastically deformed in the groove 50.

The operation of the present embodiment will now be described.

The back pressure in the back pressure chamber 35 and the circular holes 27*a* is insufficient when the scroll compressor 10 starts to operate. The sealing member 51 is held in the groove 50 with the rubber portion 53 elastically deformed in the groove 50. The deformed rubber portion 53 produces a resilient force that acts to restore the original shape of the rubber portion 53. This urges the movable scroll 23 toward the fixed scroll 22 and enhances the sealing of the compression chamber 25.

Further, when the pressure in the compression chamber 25 excessively increases and moves the distal surface of the movable spiral wall 23*b* away from the fixed base plate 22*a*, the compressed refrigerant in the compression chamber 25 flows into the inlet 36 through the gap between the distal surface of the movable spiral wall 23*b* and the fixed base plate 22*a*. The refrigerant then flows through the communication passage 38 and the outlet 37 into the back pressure chamber 35 and the circular holes 27*a*. This increases the back pressure in the back pressure chamber 35 and the circular holes 27*a*. The urging force caused by the back pressure in the back pressure chamber 35 and the circular holes 27*a* urges the movable scroll 23 to the fixed scroll 22 and moves the distal surface of the movable spiral wall 23*b* into contact with the fixed base plate 22*a*. Accordingly, the distal surface of the movable spiral wall 23*b* is pressed against the fixed scroll 22. This enhances the sealing of the compression chamber 25. In this manner, the urging of the movable scroll 23 relative to the fixed scroll 22 is controlled.

If the movable scroll 23 were urged toward the fixed scroll 22 by an urging force produced by the elastic deformation of a metal sealing member like in the prior art, it would be difficult to control the urging of the movable scroll 23 relative to the fixed scroll 22. This may cause a mechanical loss. In the present embodiment, the urging force that is produced by the elastic deformation of the rubber portion 53 and presses the movable scroll 23 against the fixed scroll 22 is smaller than the urging force produced by the elastic deformation of the conventional metal sealing member. This allows for the urging of the movable scroll 23 relative to the fixed scroll 22 to be easily controlled and limits mechanical loss.

The contact between the surface 52*a* of the resin portion 52 and the partition 21 seals the back pressure chamber 35 and the circular holes 27*a* from the region (suction pressure region) in the motor housing member 12 that is located at the outer side of the back pressure chamber 35 and the circular holes 27*a*. This effectively restricts leakage of refrigerant from the back pressure chamber 35 and the circular holes 27*a* as compared to when sealing the back pressure chamber 35 and the circular holes 27*a* from the outer region with the metal sealing member of the prior art.

The resin portion 52 partially projects out of the groove 50 toward the partition 21, and the surface 52*a* of the resin portion 52 is in contact with the partition 21. Thus, even when the pressure in the compression chamber 25 excessively increases and moves the movable scroll 23 toward the partition 21, the resin portion 52 restricts contact of the end surface 231*a* of the movable scroll 23 with the partition 21. This reduces the sliding resistance between the movable scroll 23 and the partition 21, thereby limiting mechanical loss.

The advantages of the present embodiment will now be described.

(1) The end surface 231*a* of the movable scroll 23 includes the groove 50 that holds the sealing member 51. The sealing member 51 includes the rubber portion 53, which elastically deforms in the groove 50, and the resin portion 52, which is made of a material harder than the rubber portion 53. Further, the resin portion 52 partially projects out of the groove 50 toward the partition 21. The resin portion 52 is in contact with the partition 21, which seals the back pressure chamber 35 and the circular holes 27*a*. This effectively restricts the leakage of refrigerant from the back pressure chamber 35 and the circular holes 27*a* as compared to when sealing the back pressure chamber 35 and the circular holes 27*a* with a metal sealing member like in the prior art. Further, the elastically deformed rubber portion 53 produces resilient force that acts to restore the original shape of the rubber portion 53 and urge the movable scroll 23 toward the fixed scroll 22. Thus, the movable scroll 23 is urged toward the fixed scroll 22 even when the back pressure in the back pressure chamber 35 and the circular holes 27*a* is insufficient, such as when the scroll compressor 10 starts to operate. This enhances the sealing of the compression chamber 25.

During normal operation of the scroll compressor 10, the movable scroll 23 is urged toward the fixed scroll 22 by the urging force produced by the elastic deformation of the rubber portion 53, as well as the urging force produced by the back pressure in the back pressure chamber 35 and the circular holes 27*a*. Thus, even when the urging force of the back pressure in the back pressure chamber 35 and the circular holes 27*a* sufficiently urges the movable scroll 23 toward the fixed scroll 22 and securely seals the compression chamber 25, the urging force produced by the elastic deformation of the rubber portion 53 also urges the movable scroll 23 toward the fixed scroll 22. However, the urging force of the elastic deformation of the rubber portion 53 that presses the movable scroll 23 against the fixed scroll 22 is smaller than the urging force produced by the elastic deformation of the conventional metal sealing member. This limits mechanical loss.

(2) The rubber portion 53 partially has a smaller radial width than the resin portion 52. This forms a space in the groove 50 that allows for the elastic deformation of the rubber portion 53. Thus, the rubber portion 53 can easily deform in the groove 50.

(3) The resin portion 52 and the rubber portion 53 of the sealing member 51 are integrally formed. This allows for the sealing member 51 to be easily held in the groove 50 compared to when the resin portion 52 and the rubber portion 53 are discrete from each other. In addition, sealing is ensured between the resin portion 52 and the rubber portion 53.

(4) The groove 50 is arranged in the end surface 231*a* of the movable scroll 23 at a position separated from the outer circumferential surface of the movable scroll 23. This ensures the holding of the sealing member 51 compared to when the sealing member 51 were held in a cut out portion formed in the end surface 231*a* and opening in the outer circumferential surface of the movable scroll 23, for example.

(5) The movable scroll 23 includes the inlet 36, which opens in the distal surface of the movable spiral wall 23*b*, the outlet 37, which opens to the back pressure chamber 35 and the circular holes 27*a*, and the communication passage 38, which communicates the inlet 36 and the outlet 37. Thus, when the pressure in the compression chamber 25 excessively increases and moves the distal surface of the movable spiral wall 23*b* away from the fixed base plate 22*a*, the compressed refrigerant in the compression chamber 25 flows into the inlet 36 through the gap between the distal surface of the movable spiral wall 23*b* and the fixed base plate 22*a*. The refrigerant then flows through the communication passage 38 and the outlet 37 into the back pressure chamber 35 and the circular holes 27*a*. This increases the back pressure in the back pressure chamber 35 and the circular holes 27*a*. The urging force produced by the back pressure in the back pressure chamber 35 and the circular holes 27*a* urges the movable scroll 23 to the fixed scroll 22 and moves the distal surface of the movable spiral wall 23*b* into contact with the fixed base plate 22*a*. Accordingly, the distal surface of the movable spiral wall 23*b* is pressed against the fixed scroll 22. This enhances the sealing of the compression chamber 25. In this manner, the urging of the movable scroll 23 relative to the fixed scroll 22 is controlled. If the movable scroll 23 were urged toward the fixed scroll 22 by the urging force produced by the elastic deformation of a metal sealing member like in the prior art, the urging of the movable scroll 23 relative to the fixed scroll 22 would be difficult to control adequately. This may cause a mechanical loss. In the present embodiment, the urging force produced by the elastic deformation of the rubber portion 53 that presses the movable scroll 23 against the fixed scroll 22 is smaller than the urging force produced by the elastic deformation of the conventional metal sealing member. This allows for easy control of the urging of the movable scroll 23 relative to the fixed scroll 22 and limits mechanical loss.

(6) The resin portion 52 of the sealing member 51 faces the partition 21. This increases the wear resistance of the sealing member 51 that slides on the partition 21 when the movable scroll 23 orbits as compared to when a rubber portion of the sealing member 51 faces toward the partition 21.

(7) The present embodiment does not include a metal sealing member like in the prior art. This eliminates the need for a recess in the partition 21 to allow for elastic deformation of the metal sealing member and facilitates the manufacturing of the partition 21.

(8) The resin portion 52 includes a flat surface that faces the partition 21. This allows for planer contact between the surface 52*a* of the resin portion 52 and the partition 21. Thus, the area of contact between the resin portion 52 and the partition 21 is enlarged compared to when the resin portion 52 and the partition 21 are in liner contact (or point contact). This enhances the sealing of the back pressure chamber 35 and the circular holes 27*a* from the region of the motor housing member 12 located at the outer side of the back pressure chamber 35 and the circular holes 27*a*.

(9) The resin portion 52 partially projects out of the groove 50 toward the partition 21, and the surface 52*a* of the resin portion 52 is in contact with the partition 21. Thus, even when the pressure in the compression chamber 25 excessively increases and moves the movable scroll 23 toward the partition 21, contact of the end surface 231*a* of the movable scroll 23 with the partition 21 is restricted. This reduces the sliding resistance between the movable scroll 23 and the partition 21, and limits mechanical loss.

It should be apparent to those skilled in the art that the present invention may be embodied in many other specific forms without departing from the spirit or scope of the invention. Particularly, it should be understood that the present invention may be embodied in the following forms.

Figure 4:
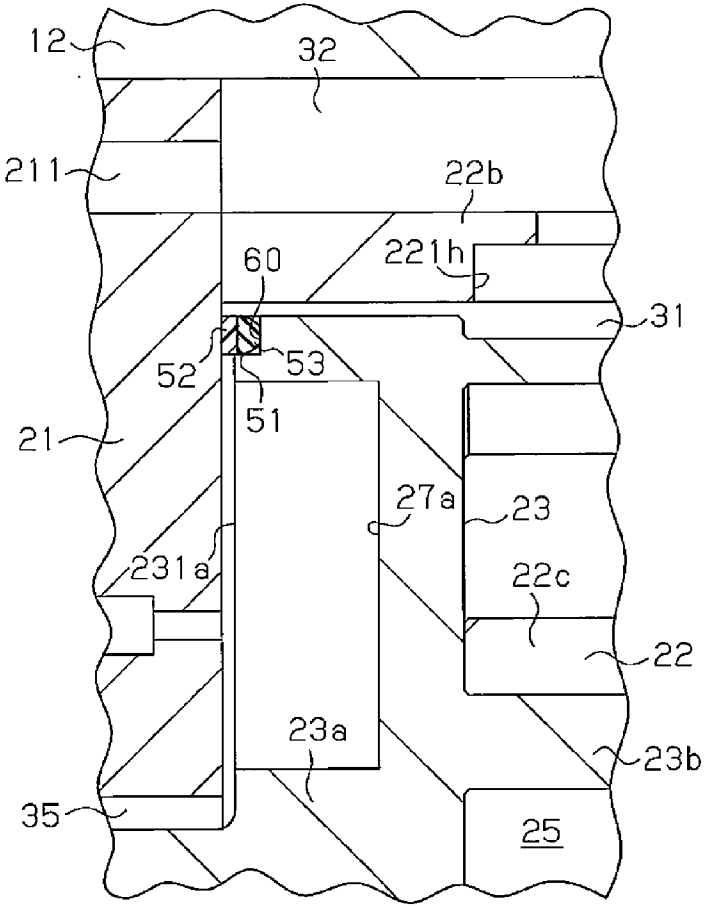
FIG. 4 is an enlarged cross-sectional view showing a scroll compressor of another embodiment.

As shown in FIG. 4, the end surface 231*a* of the movable scroll 23 may include a cut out portion 60, which serves as a holding portion. The cut out portion 60 opens in the outer circumferential surface of the movable scroll 23. The cut out portion 60 is easier to form in the movable scroll 23 than a recess formed in the end surface 231*a* at a position separated from the outer circumferential surface of the movable scroll 23.

Figure 5:
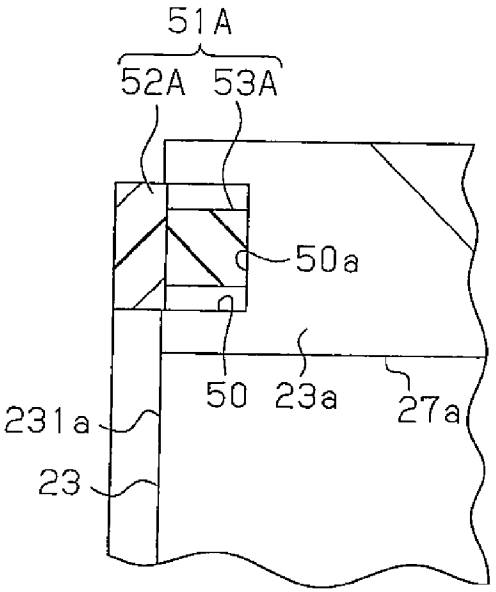
FIG. 5 is an enlarged cross-sectional view showing a sealing member of a further embodiment before a rubber portion elastically deforms.
Figure 7:
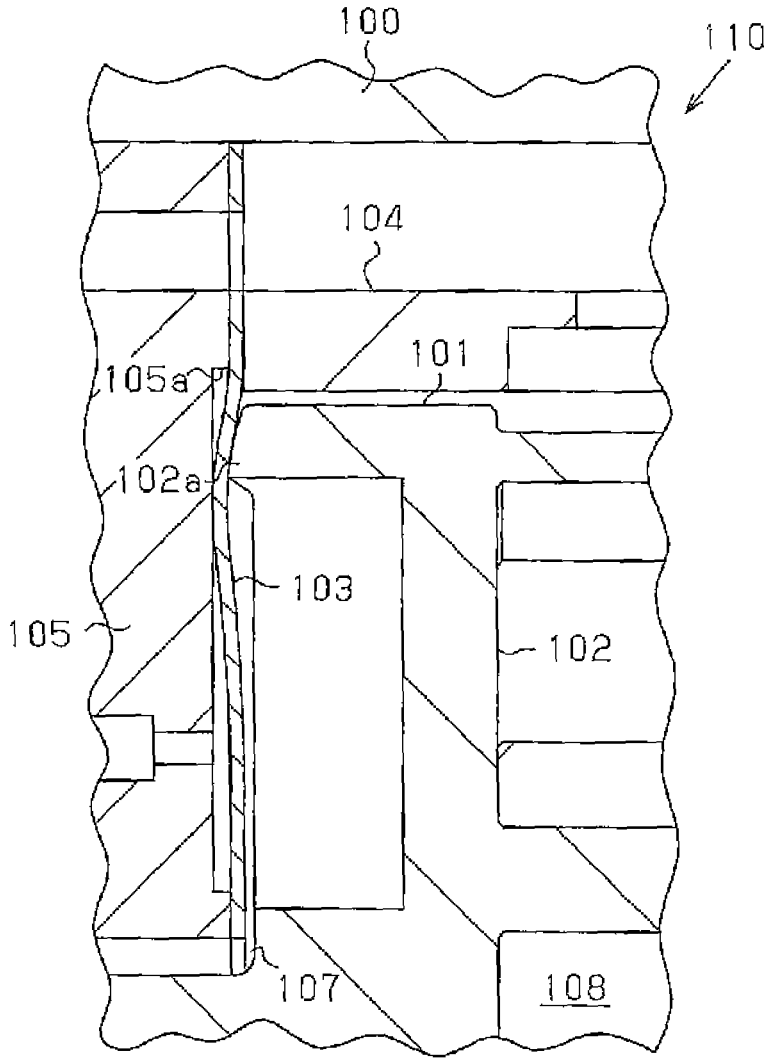
Fig.7 PRIOR ART
FIG. 7 is an enlarged cross-sectional view showing a conventional scroll compressor.

As shown in FIG. 5, an annular sealing member 51A may include an annular resin portion 52A and an annular rubber portion 53A, which extends from an end surface of the resin portion 52A. The rubber portion 53A may include inner and outer surfaces extending perpendicular to the end surface of the resin portion 52A. The rubber portion 53A has a larger inner diameter than the resin portion 52A and a smaller outer diameter than the resin portion 52A. In this manner, the width of the rubber portion 53A in the radial direction is smaller than that of the resin portion 52A along entire axial dimension of the rubber portion 53A.

Figure 6:
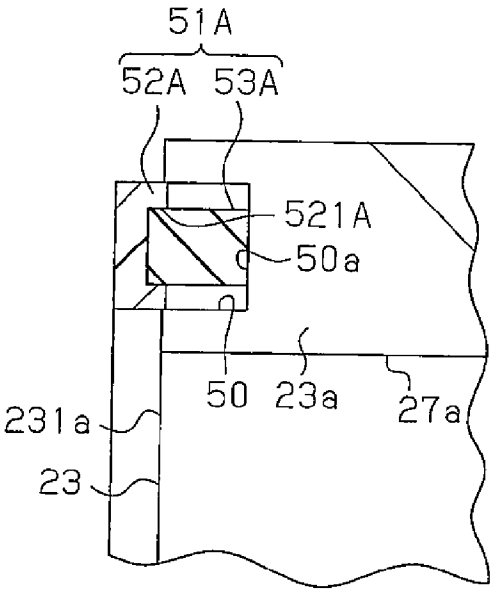
FIG. 6 is an enlarged cross-sectional view showing a sealing member of yet another embodiment before a rubber portion elastically deforms.

As shown in FIG. 6, the resin portion 52A may include a fitting groove 521A in the end surface facing the rubber portion 53A. The rubber portion 53A may be fitted into the fitting groove 521A. This enhances the connection and the sealing between the resin portion 52A and the rubber portion 53A.

The rubber portion 53 and the resin portion 52 may have the same radial width.

The resin portion 52 may have a curved surface that faces the partition 21. This allows for the resin portion 52 and the partition 21 to be in linear contact (or point contact).

The resin portion 52 may entirely project out of the groove 50 toward the partition 21.

The resin portion 52 and the rubber portion 53 may be discrete from each other. In this case, it is preferable that the resin portion 52 and the rubber portion 53 are fitted to each other as shown in FIG. 6, for example, to secure the connection and the sealing between the resin portion 52 and the rubber portion 53.

The back pressure chamber 35 and the circular holes 27*a* may be supplied with refrigerant from the discharge region.

The present examples and embodiments are to be considered as illustrative and not restrictive and the invention is not to be limited to the details given herein, but may be modified within the scope and equivalence of the appended claims.

The invention claimed is:

1. A scroll compressor comprising:

a housing;

a fixed scroll located in and fixed to the housing;

a movable scroll that orbits with respect to the fixed scroll, wherein a compression chamber is formed between the movable scroll and the fixed scroll;

an opposing wall located in and fixed to the housing, wherein a back pressure region is formed between the opposing wall and the movable scroll, and a back pressure in the back pressure region urges the movable scroll toward the fixed scroll; and an annular sealing member arranged between the movable scroll and the opposing wall, wherein the movable scroll includes an end surface that faces the opposing wall and the end surface includes a holding portion, wherein the holding portion holds the sealing member, the sealing member includes a rubber portion, which elastically deforms in the holding portion, and a resin portion, which is made of a material harder than the rubber portion, the resin portion at least partially projects out of the holding portion toward the opposing wall, and the resin portion is in contact with the opposing wall, the rubber portion includes a flat surface that faces the resin portion, and the resin portion includes a flat surface that faces the rubber portion, and a space is formed between the holding portion and the rubber portion to allow the rubber portion to elastically deform in the holding portion.

2. The scroll compressor according to claim 1, wherein the rubber portion at least partially has a smaller radial width than the resin portion.

3. The scroll compressor according to claim 1, wherein the resin portion and the rubber portion are integrally formed.

4. The scroll compressor according to claim 1, wherein the resin portion and the rubber portion are discrete from each other, and the resin portion includes a groove into which the rubber portion is fitted.

5. The scroll compressor according to claim 1, wherein the holding portion is a groove located at a position separated from an outer circumferential surface of the movable scroll.

6. The scroll compressor according to claim 1, wherein the holding portion is a cut out portion that opens in an outer circumferential surface of the movable scroll.

7. The scroll compressor according to claim 1, wherein the fixed scroll includes a fixed base plate and a fixed spiral wall projecting from the fixed base plate, the movable scroll includes a movable base plate and a movable spiral wall projecting from the movable base plate, the fixed spiral wall and the movable spiral wall are engaged with each other to define the compression chamber, and the movable scroll includes an inlet that opens in a distal surface of the movable spiral wall, an outlet that opens in the back pressure region, and a communication passage that communicates the inlet and the outlet.

8. The scroll compressor according to claim 1, wherein the resin portion includes a flat surface that is in contact with the opposing wall.

9. The scroll compressor according to claim 1, further comprising a rotation restriction mechanism that restricts rotation of the movable scroll while permitting the orbital motion of the movable scroll, and the sealing member is arranged radially outside the rotation restriction mechanism.

10. The scroll compressor according to claim 1, wherein the flat surfaces of the resin portion and the rubber portion that face each other are connected.

* * * * *